US012188328B2

(12) United States Patent
Baki et al.

(10) Patent No.: US 12,188,328 B2
(45) Date of Patent: Jan. 7, 2025

(54) WELLBORE BACK PRESSURE VALVE WITH PRESSURE GAUGE

(71) Applicant: Saudi Arabian Oil Company, Dhahran (SA)

(72) Inventors: Sohrat Baki, Dhahran (SA); Mustafa Karakaya, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/317,664

(22) Filed: May 15, 2023

(65) Prior Publication Data

US 2024/0384623 A1 Nov. 21, 2024

(51) Int. Cl.

| | |
|---|---|
| ***E21B 34/02*** | (2006.01) |
| ***E21B 34/06*** | (2006.01) |
| ***E21B 47/06*** | (2012.01) |

(52) U.S. Cl.

CPC ..... *E21B 34/02* (2013.01); *E21B 34/06* (2013.01); *E21B 47/06* (2013.01)

(58) Field of Classification Search

CPC ..... E21B 47/06; E21B 17/042; E21B 23/023; E21B 34/06

See application file for complete search history.

(56) References Cited

U.S. PATENT DOCUMENTS

| | | | | |
|---|---|---|---|---|
| 2,313,169 | A * | 3/1943 | Penick | E21B 33/04 285/123.6 |
| 3,592,230 | A | 7/1971 | Piroutek et al. | |
| 3,805,833 | A | 4/1974 | Teed | |
| 4,295,489 | A | 10/1981 | Arends et al. | |
| 4,619,115 | A | 10/1986 | Weber | |
| 4,660,863 | A | 4/1987 | Bailey et al. | |
| 4,739,475 | A | 4/1988 | Mensch | |
| 4,754,810 | A | 7/1988 | Bennett et al. | |
| 4,755,456 | A | 7/1988 | Sugimoto | |
| 4,792,523 | A | 12/1988 | Wong et al. | |
| 4,830,109 | A | 5/1989 | Wedel | |
| 4,869,288 | A | 9/1989 | Toshio et al. | |
| 4,914,014 | A | 4/1990 | Daubendiek et al. | |
| 5,253,712 | A | 10/1993 | Swor | |
| 5,279,952 | A | 1/1994 | Wu | |
| 5,318,888 | A | 6/1994 | Weberg et al. | |
| 5,320,181 | A | 6/1994 | Lantier, Sr. et al. | |
| 5,374,553 | A | 12/1994 | Gelfand et al. | |
| 5,420,029 | A | 5/1995 | Gelfand et al. | |
| 5,494,422 | A | 2/1996 | Ukai et al. | |
| 5,595,864 | A | 1/1997 | Van den Zegel et al. | |
| 5,616,455 | A | 4/1997 | Murphy | |

(Continued)

*Primary Examiner* — Brad Harcourt

(74) *Attorney, Agent, or Firm* — Fish & Richardson P.C.

(57) ABSTRACT

A wellbore back pressure valve with pressure gauge includes a back pressure valve (BPV) that can be installed at a location in a wellbore production tubing that can be installed in a wellbore. The BPV can fluidically isolate a portion of the wellbore production tubing downhole of the location from a portion of the wellbore production tubing uphole of the location. A threaded connection is attached to a downhole end of the BPV. The threaded connection includes multiple first threads. A pressure gauge is fluidically coupled to the BPV through the threaded connection. The pressure gauge can measure a pressure in the portion of the wellbore downhole of the location.

19 Claims, 5 Drawing Sheets

(56) References Cited

U.S. PATENT DOCUMENTS 5,624,833 A 4/1997 Gelfand et al.
5,702,879 A 12/1997 Barcock
5,714,323 A 2/1998 Ohshima et al.
5,743,335 A 4/1998 Bussear
5,785,120 A 7/1998 Smalley et al.
5,827,177 A 10/1998 Oneda et al.
5,829,524 A 11/1998 Flanders et al.
5,834,280 A 11/1998 Oxenboll et al.
5,853,702 A 12/1998 Berka et al.
5,856,733 A 1/1999 Matsumoto et al.
5,874,275 A 2/1999 Berka et al.
5,879,921 A 3/1999 Cherry et al.
5,954,132 A 9/1999 Harris et al.
5,957,195 A 9/1999 Bailey et al.
6,020,708 A 2/2000 Matsumoto et al.
6,039,120 A 3/2000 Wilkins et al.
6,093,554 A 7/2000 Haute et al.
6,105,673 A 8/2000 Harris et al.
6,139,286 A 10/2000 Muscarella
6,142,230 A 11/2000 Smalley et al.
6,197,542 B1 3/2001 Haute et al.
6,220,363 B1 4/2001 Dallas
6,302,208 B1 10/2001 Walker et al.
6,386,509 B1 5/2002 Mastuzawa et al.
6,403,056 B1 6/2002 Unger
6,523,110 B1 2/2003 Bright et al.
6,554,592 B1 4/2003 Sun et al.
6,558,892 B2 5/2003 Elst et al.
6,587,187 B2 7/2003 Watanabe et al.
6,621,946 B2 9/2003 Yu et al.
6,668,930 B2 12/2003 Hoffman
6,775,894 B2 8/2004 Hardin
6,808,720 B2 10/2004 Unger
6,825,637 B2 11/2004 Kinpara et al.
6,840,325 B2 1/2005 Stephenson
6,866,061 B2 3/2005 Ye et al.
6,878,549 B1 4/2005 Vogels et al.
7,003,619 B1 2/2006 Moore et al.
7,039,786 B2 5/2006 Suzuki et al.
7,048,125 B2 5/2006 Mize et al.
7,164,999 B2 1/2007 Tabatabaei et al.
7,272,503 B2 9/2007 Strack et al.
7,303,595 B1 12/2007 Janitz
7,308,934 B2 12/2007 Swagerty et al.
7,312,075 B1 12/2007 Yamamura et al.
7,347,840 B2 3/2008 Findlay et al.
PP18,942 P2 6/2008 Boer
PP18,969 P2 6/2008 Boer
7,401,647 B2 7/2008 Baycroft et al.
7,478,679 B2 1/2009 Berzin et al.
7,490,666 B2 2/2009 Swagerty et al.
7,614,448 B2 11/2009 Swagerty et al.
7,615,355 B2 11/2009 Papadopoulos et al.
7,633,992 B1 12/2009 Miao et al.
7,718,684 B2 5/2010 Jung et al.
7,730,940 B2 6/2010 Knippa et al.
7,743,824 B2 6/2010 Lam et al.
7,823,634 B2 11/2010 Chan et al.
7,861,775 B2 1/2011 Palmer et al.
7,900,697 B2 3/2011 Swagerty et al.
7,934,550 B2 5/2011 Bolding et al.
7,954,793 B2 6/2011 Weisbeck et al.
7,997,338 B2 8/2011 Foster et al.
8,034,548 B2 10/2011 Sawyers et al.
8,087,459 B2 1/2012 Caldwell et al.
8,117,819 B2 2/2012 Scott
8,127,978 B2 3/2012 Castillo et al.
8,136,604 B2 3/2012 Jennings
8,157,006 B2 4/2012 Koleilat et al.
8,194,885 B2 6/2012 Brannmark et al.
8,225,861 B2 7/2012 Foster et al.
8,235,108 B2 8/2012 Lemme et al.
8,251,142 B2 8/2012 Hinkie
8,302,678 B2 11/2012 Swagerty et al.
8,327,943 B2 12/2012 Borak et al.
8,371,374 B2 2/2013 Foster et al.
8,396,667 B2 3/2013 Nutley et al.
8,397,802 B2 3/2013 Lembcke
8,499,842 B2 8/2013 Nguyen et al.
8,506,932 B2 8/2013 Arstad et al.
8,539,976 B1 9/2013 Rodgers, Jr. et al.
8,550,156 B2 10/2013 Castillo et al.
8,616,289 B2 12/2013 Nguyen et al.
8,636,058 B2 1/2014 Nguyen et al.
8,646,533 B2 2/2014 Nguy et al.
8,674,637 B2 3/2014 Kamijo
8,678,406 B1 3/2014 Albertson
8,726,925 B2 5/2014 Clifford
8,727,012 B2 5/2014 Bhat
8,794,310 B2 8/2014 Allen et al.
8,823,558 B2 9/2014 Barrett
8,899,316 B2 12/2014 Krawiec et al.
8,910,709 B2 12/2014 Thomson et al.
8,936,075 B2 1/2015 Guidry
8,997,457 B2 4/2015 Leone et al.
9,051,539 B2 6/2015 Synder et al.
9,081,390 B2 7/2015 Andersson
9,168,317 B2 10/2015 Jones
9,194,201 B2 11/2015 Simson et al.
9,200,299 B2 12/2015 Friedman et al.
9,200,498 B2 12/2015 Klimack
9,239,016 B2 1/2016 Leone et al.
9,243,473 B2 1/2016 Yang et al.
9,284,378 B2 3/2016 Hu et al.
9,284,812 B2 3/2016 Mazyar et al.
9,297,226 B2 3/2016 Nguyen et al.
9,314,541 B2 4/2016 Jones
9,422,788 B2 8/2016 Nguyen et al.
9,447,671 B2 9/2016 Nguyen et al.
9,493,577 B2 11/2016 Hu et al.
9,506,051 B2 11/2016 Moe et al.
9,517,264 B2 12/2016 Fachini et al.
9,523,256 B2 12/2016 Bilansky et al.
9,574,002 B2 2/2017 Li et al.
9,587,460 B2 3/2017 Clemens
9,624,855 B2 4/2017 Leone et al.
9,637,997 B2 5/2017 Goodman et al.
9,695,659 B2 7/2017 Davis et al.
9,702,211 B2 7/2017 Tinnen
9,770,046 B2 9/2017 Negri
9,810,038 B2 11/2017 Cocker, III
9,909,381 B2 3/2018 Kajaria et al.
9,925,825 B1 3/2018 Hoffman et al.
9,976,380 B2 5/2018 Davis et al.
10,060,283 B2 8/2018 Tomigashi et al.
10,132,141 B2 11/2018 Caccialupi et al.
10,159,841 B2 12/2018 Chin et al.
10,173,936 B2 1/2019 Flato et al.
10,230,430 B2 3/2019 Uchino et al.
10,287,846 B2 5/2019 Andersen et al.
10,319,092 B2 6/2019 Wu et al.
10,364,635 B2 7/2019 Puccio et al.
10,447,070 B2 10/2019 Qin et al.
10,450,832 B2 10/2019 Hickie
10,487,302 B2 11/2019 Spangenburg et al.
10,487,607 B2 11/2019 Kajaria et al.
10,570,205 B2 2/2020 Hu et al.
10,597,649 B2 3/2020 Moe et al.
10,604,693 B2 3/2020 Kim et al.
10,612,349 B2 4/2020 Clemens
10,633,966 B2 4/2020 Pollak et al.
10,655,423 B2 5/2020 Stein et al.
10,662,762 B2 5/2020 Alnughaimish et al.
10,675,623 B2 6/2020 Andreyev et al.
10,677,011 B2 6/2020 Al-Abduljabbar et al.
10,689,947 B2 6/2020 Montoya et al.
10,724,344 B2 7/2020 Dietz
10,738,560 B2 8/2020 Duan et al.
10,743,590 B2 8/2020 Moussa et al.
10,753,173 B2 8/2020 Voll et al.
10,780,659 B2 9/2020 Ahrenholtz
10,787,883 B2 9/2020 Montoya et al.
RE48,308 E 11/2020 Flato et al.
10,837,264 B2 11/2020 Filippov et al.

(56) References Cited

U.S. PATENT DOCUMENTS 10,893,527 B2 1/2021 Lee et al.
10,939,831 B2 3/2021 Al-Ali
10,941,769 B2 3/2021 Teshima et al.
10,947,813 B2 3/2021 Ejim et al.
10,966,224 B2 3/2021 Yu et al.
10,982,499 B2 4/2021 Alshuraim
11,041,357 B2 6/2021 Pounds
11,053,769 B2 7/2021 Craycraft
11,053,796 B2 7/2021 Craycraft
11,058,837 B2 7/2021 Stam et al.
11,096,194 B2 8/2021 Tang
11,105,416 B2 8/2021 Langenbacher et al.
11,142,732 B2 10/2021 Spangenburg et al.
11,142,993 B2 10/2021 Boyd et al.
11,174,700 B2 11/2021 Fripp et al.
11,193,119 B2 12/2021 Swenson et al.
11,193,357 B2 12/2021 Clemens
11,230,906 B2 1/2022 Palmer et al.
11,248,052 B2 2/2022 Li et al.
11,268,342 B2 3/2022 Andersen et al.
11,293,270 B2 4/2022 Malone et al.
11,299,955 B2 4/2022 Fripp et al.
11,365,599 B2 6/2022 Glaesman
11,437,156 B2 9/2022 Russell, II et al.
11,440,521 B2 9/2022 Thiel
11,473,388 B2 10/2022 Al-Kunin
11,827,669 B2 11/2023 Wingfield et al.
2001/0048040 A1 12/2001 Sheldon
2002/0119942 A1 8/2002 Vogels et al.
2003/0100100 A1 5/2003 Jacobs, Jr. et al.
2003/0157095 A1 8/2003 Papadopoulos et al.
2004/0210790 A1 10/2004 Moon et al.
2005/0074885 A1 4/2005 Vogels et al.
2005/0173112 A1* 8/2005 Kavaklioglu ..... E21B 43/122 166/372
2006/0106202 A1 5/2006 Papadopoulos et al.
2006/0238437 A1 10/2006 Huang
2008/0177592 A1 7/2008 Masuyama et al.
2008/0254372 A1 10/2008 Wu
2008/0254373 A1 10/2008 Wu
2010/0015114 A1 1/2010 Papadopoulos et al.
2010/0068779 A1 3/2010 Wells et al.
2010/0258311 A1 10/2010 Craig et al.
2011/0081295 A1 4/2011 Papadopoulos et al.
2012/0012343 A1 1/2012 Wilkin et al.
2012/0024521 A1 2/2012 Villa
2012/0100173 A1 4/2012 Leclair et al.
2013/0105388 A1 5/2013 Johnson et al.
2013/0288228 A1 10/2013 Anderson et al.
2014/0058677 A1 2/2014 Combee
2014/0116720 A1* 5/2014 He ..... E21B 21/10 166/373
2014/0234269 A1 8/2014 Taylor
2014/0261785 A1 9/2014 Andersson
2015/0012664 A1 1/2015 Johnson
2015/0041126 A1 2/2015 Boyle et al.
2015/0041129 A1 2/2015 Mani et al.
2015/0073523 A1 3/2015 Chobotov
2015/0090255 A1 4/2015 Gulliver et al.
2015/0278138 A1 10/2015 Seidel et al.
2015/0307567 A1 10/2015 Leclair et al.
2015/0347246 A1 12/2015 Matsui et al.
2015/0378937 A1 12/2015 Yang et al.
2016/0033047 A1 2/2016 Seo
2016/0186527 A1 6/2016 Cocker, III
2017/0016403 A1 1/2017 Ha
2017/0037151 A1 2/2017 Brake et al.
2017/0183412 A1 6/2017 Li et al.
2017/0198273 A1 7/2017 Moe et al.
2018/0124634 A1 5/2018 Jose et al.
2018/0163506 A1 6/2018 Montoya et al.
2018/0171740 A1 6/2018 Casanova
2018/0313182 A1 11/2018 Cherewyk et al.
2018/0371034 A1 12/2018 Leclair et al.
2019/0055839 A1 2/2019 Skillingstad et al.
2019/0136226 A1 5/2019 Swenson et al.
2019/0151844 A1 5/2019 Andreyev et al.
2019/0248906 A1 8/2019 Li et al.
2019/0249791 A1 8/2019 Chapman, Jr.
2019/0321264 A1 10/2019 Gulliver et al.
2019/0360292 A1* 11/2019 Boyd ..... E21B 33/03
2019/0376094 A1 12/2019 Friedman et al.
2020/0003032 A1 1/2020 Chen et al.
2020/0086324 A1 3/2020 Swenson et al.
2020/0216546 A1 7/2020 Hu et al.
2020/0248523 A1* 8/2020 Craycraft ..... E21B 33/04
2020/0263158 A1 8/2020 Moe et al.
2020/0346213 A1 11/2020 Andreyev et al.
2020/0375265 A1 12/2020 Moussa et al.
2020/0393040 A1 12/2020 Langenbacher et al.
2020/0406257 A1 12/2020 Andreyev et al.
2021/0108478 A1 4/2021 Filippov et al.
2021/0108490 A1 4/2021 Filippov et al.
2021/0121545 A1 4/2021 Knoll et al.
2021/0324699 A1 10/2021 Trumbull et al.
2021/0370000 A1 12/2021 Stam et al.
2021/0380668 A1 12/2021 Wingfield et al.
2022/0068512 A1 3/2022 Russell, II et al.
2022/0081986 A1 3/2022 Roselier et al.
2022/0081989 A1 3/2022 Muballa et al.
2022/0086848 A1 3/2022 Sharma et al.
2022/0120155 A1 4/2022 Firth et al.
2022/0186208 A1 6/2022 Swenson et al.
2022/0228667 A1 7/2022 Kora
2022/0290523 A1 9/2022 Al-Kunin
2022/0299151 A1 9/2022 Lee et al.
2024/0084661 A1 3/2024 Karakaya et al.

* cited by examiner

WELLBORE BACK PRESSURE VALVE WITH PRESSURE GAUGE

TECHNICAL FIELD

This disclosure relates to wellbore operations and more specifically to sealing wellbore tubing.

BACKGROUND

Hydrocarbons (e.g., petroleum, natural gas, combinations of them) entrapped in subsurface reservoirs can be raised to the surface (i.e., produced) by forming wellbores from the surface to the subsurface reservoir. A wellbore is formed through a subterranean zone (e.g., a formation, a portion of a formation, multiple formations) using a drilling assembly. After or during such wellbore formation, the well is cased and cemented. Then, production tubing is run into the wellbore from the surface to the subsurface reservoir. After forming the wellbore and installing the production tubing, well completions are installed in the wellbore (including in the production tubing). Well completions are well tools such as packers, valves, and the like, that are used to operate and control fluid flow through the wellbore. A back pressure valve (BPV) is an example of a well completion. A BPV is used to fluidically isolate a production tubing

SUMMARY

This disclosure describes technologies relating to wellbore back pressure valve with pressure gauge.

Certain aspects of the subject matter described here can be implemented as a wellbore tool assembly. The assembly includes a back pressure valve (BPV) that can be installed at a location in a wellbore production tubing that can be installed in a wellbore. The BPV can fluidically isolate a portion of the wellbore production tubing downhole of the location from a portion of the wellbore production tubing uphole of the location. A threaded connection is attached to a downhole end of the BPV. The threaded connection includes multiple first threads. A pressure gauge is fluidically coupled to the BPV through the threaded connection. The pressure gauge can measure a pressure in the portion of the wellbore downhole of the location.

An aspect combinable with any other aspect includes the following features. The pressure gauge includes multiple second threads that can mate with the multiple first threads to form a fluidic coupling between the BPV and the pressure gauge.

An aspect combinable with any other aspect includes the following features. The multiple first threads are formed on an inner surface of the threaded connection, and the multiple second threads are formed on an outer surface of the pressure gauge.

An aspect combinable with any other aspect includes the following features. The BPV coupled to the pressure gauge can allow fluid flow from the portion of the wellbore production tubing uphole of the location to the portion of the wellbore production tubing downhole of the location, and prevent fluid flow from the portion of the wellbore production tubing downhole of the location to the portion of the wellbore production tubing uphole of the location.

An aspect combinable with any other aspect includes the following features. The pressure gauge includes an end that is coupled to the threaded connection and an opposite end. The opposite end is open to fluid flow.

An aspect combinable with any other aspect includes the following features. The pressure gauge includes a memory that can store the pressure in the portion of the wellbore downhole of the location that is measured by the pressure gauge.

An aspect combinable with any other aspect includes the following features. The threaded connection is attached to the downhole end of the BPV by metal-to-metal threads.

An aspect combinable with any other aspect includes the following features. The assembly includes a tubing hanger landing joint configured to be installed in the wellbore uphole of the wellbore production tubing. The tubing hanger landing joint can hang the wellbore production tubing. The tubing hanger landing join can receive the BPV fluidically coupled to the pressure gauge.

Certain aspects of the subject matter described in this disclosure can be implemented as a method. A threaded connection is attached to a downhole end of a BPV. A pressure gauge is fluidically coupled to the threaded connection. The BPV, fluidically coupled to the pressure gauge at a location in a wellbore production tubing, is installed in a wellbore. The BPV fluidically isolates a portion of the wellbore production tubing downhole of the location from a portion of the wellbore production tubing uphole of the location. Simultaneously with fluidically isolating, the pressure gauge measures a pressure in the portion of the wellbore production tubing downhole of the location.

An aspect combinable with any other aspect includes the following features. To attach the threaded connection to the downhole end of the BPV, a metal-to-metal threaded connection is formed between the downhole end of the BPV and the threaded connection.

An aspect combinable with any other aspect includes the following features. To fluidically couple the pressure gauge to the threaded connection, multiple first threads formed on an inner surface of the threaded connection are coupled to multiple second threads formed on an outer surface of the threaded connection.

An aspect combinable with any other aspect includes the following features. To fluidically isolate, by the BPV, the portion of the wellbore production tubing downhole of the location from the portion of the wellbore production tubing uphole of the location, the BPV allows fluid flow from the portion of the wellbore production tubing uphole of the location to the portion of the wellbore production tubing downhole of the location. In addition, the BPV prevents fluid flow from the portion of the wellbore production tubing downhole of the location to the portion of the wellbore production tubing uphole of the location.

An aspect combinable with any other aspect includes the following features. To allow the fluid flow from the portion of the wellbore production tubing uphole of the location to the portion of the wellbore production tubing downhole of the location, the BPV allows the fluid flow through a downhole end of the pressure gauge into the BPV.

An aspect combinable with any other aspect includes the following features. The wellbore is formed. A casing string is installed in the wellbore. A tubing hanger landing joint is installed in the casing string. The wellbore production tubing is hung from the tubing hanger landing joint. The BPV fluidically coupled to the pressure gauge is installed within the tubing hanger landing joint.

Certain aspects of the subject matter described here can be implemented as a wellbore tool assembly. The assembly includes a tubing hanger landing joint configured to be installed in a wellbore uphole of a wellbore production tubing. The tubing hanger landing joint can hang the wellbore production tubing. A back pressure valve-pressure gauge sub-assembly can be installed in the tubing hanger landing joint. The sub-assembly includes a BPV that can be installed at a location in a wellbore production tubing. A threaded connection is attached to a downhole end of the BPV. The threaded connection includes multiple first threads. A pressure gauge is fluidically coupled to the BPV through the threaded connection. The pressure gauge can measure a pressure in the portion of the wellbore downhole of the location while the BPV can simultaneously fluidically isolate a portion of the wellbore production tubing downhole of the location from a portion of the wellbore production tubing uphole of the location.

An aspect combinable with any other aspect includes the following features. The pressure gauge includes multiple second threads that can mate with the multiple first threads to form a fluidic coupling between the BPV and the pressure gauge.

An aspect combinable with any other aspect includes the following features. The multiple first threads are formed on an inner surface of the threaded connection and the multiple second threads are formed on an outer surface of the pressure gauge.

An aspect combinable with any other aspect includes the following features. The pressure gauge includes a memory configured to store the pressure in the portion of the wellbore downhole of the location that is measured by the pressure gauge.

An aspect combinable with any other aspect includes the following features. The assembly includes a production tree that can be installed uphole of the sub-assembly. The production tree is coupled to the BPV and configured to control fluid flow through the sub-assembly.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
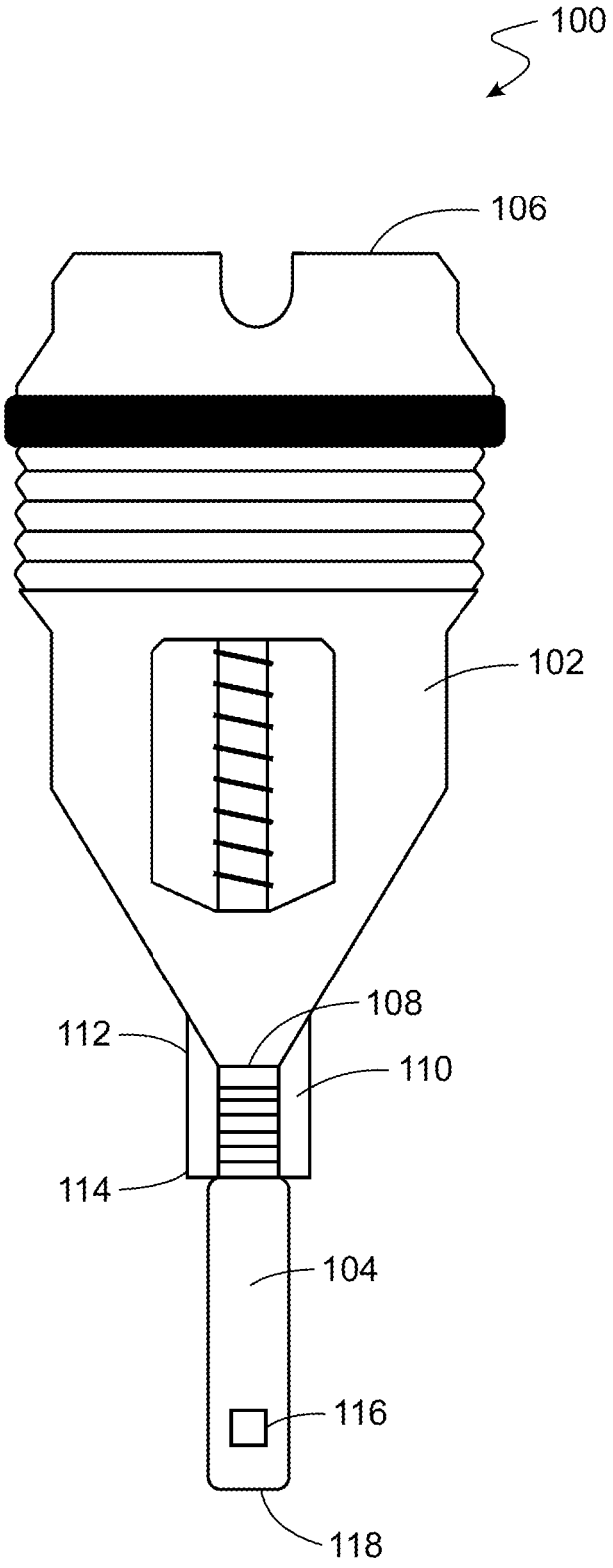
FIG. 1 is a schematic diagram of a sub-assembly including a back pressure valve (BPV) and pressure gauge.

A BPV is a well tool that is installed in a tubing hanger to isolate production tubing. The BPV is designed to hold pressure from below to isolate well pressure downhole of a location at which the BPV is installed. The BPV is also designed to pump fluid, at a low flowrate, from uphole of the location at which the BPV is installed. As described below, the BPV is designed to set at a tubing hanger. The BPV is usually below ground level (i.e., a surface of the Earth at which the wellbore is formed) and is part of a wellhead barrier. The BPV is configured to minimize potential leak from the well with the benefit of being located inside (i.e., too far deep within) the wellbore. Consequently, the BPV is easier to retrieve compared with other well tools that are installed deeper within the wellbore and may require complex retrieval operations. The BPV can be used for either short term shut-ins of the wellbore or for longer term suspensions of wellbore operations. If an incident occurs at the wellhead tree valves, the BPV can still hold pressure from below and prevent leakage from the wellbore.

A pressure gauge is a well tool that is used to monitor wellbore pressure, in particular, at locations at which a seal or a fluidic isolation is created. Pressure measured by the pressure gauge can be used by well operators in different phases of wellbore operations including production, injection, shut-in conditions, and the like. Thus, the pressure gauge allows wellbore operators to evaluate subsurface well data. Pressure gauges can include built-in memories (e.g., computer-readable processors and memory), and can be run into the wellbore to record measured pressure and to store the measured pressure in the built-in memories. Examples of other gauges that can be used in place of pressure gauges include temperature gauges that can measure wellbore temperatures and combination gauges that can measure wellbore pressures and temperatures.

This disclosure describes a sub-assembly that includes a BPV to which a pressure gauge (or a temperature gauge or a pressure and temperature gauge) is mounted. The sub-assembly can be used to seal and fluidically isolate a wellbore production string. While sealing and fluidically isolating the wellbore production string, the sub-assembly can simultaneously and continuously measure wellbore properties (pressure or temperature or both) in the fluidically isolated portion of the wellbore production string. The measured wellbore properties can either be stored in memories onboard the gauge or can be wirelessly transmitted to a surface of the wellbore.

The BPV-pressure gauge sub-assembly described in this disclosure can be implemented to perform wellbore monitoring operations that are an important aspect of oil and gas wellbore operations. For example, when performing a diagnostic injection test for evaluation of subsurface reservoir behavior of the subterranean zone, small volume (e.g., 10-30 barrels) of water-based fluid can be pumped or injected at low rate into the wellbore. The pumping can then be stopped and the pressure response over time monitored (e.g., for 1-10 days) to evaluate reservoir properties and behavior or tightness (e.g., frac gradient, minimal in-situ stress, fracture closure pressure, reservoir permeability, etc.). The sub-assembly described in this disclosure can be implemented to monitor the pressure response over time. Because the sub-assembly is installed within the wellbore (or the wellhead), as opposed to outside the wellbore (or the wellhead), negative impact on pressure measurements due to day and night temperature changes can be minimized or avoided. The need to install production trees on top of the wellbore to record the pressure from surface-installed pressure gauges can also be avoided by using the sub-assembly described here. The risk of leaks associated with surface-installed equipment can also be reduced by implementing the sub-assembly described here, which is installed inside the wellbore. In addition, the sub-assembly described here can simultaneously and continuously perform the dual function of sealing the wellbore production string and measuring pressure (or other well properties) in the location downhole of the sub-assembly.

FIG. 1 is a schematic diagram of a sub-assembly 100 including a back pressure valve (BPV) 102 and pressure gauge 104. The sub-assembly 100 can be a component sub-assembly of a wellbore tool assembly described later. The BPV 102 is configured to be installed at a location in a wellbore production tubing, which, in turn, is configured to be installed in a wellbore. The BPV is configured to fluidically isolate a portion of the wellbore production tubing downhole of the location from a portion of the wellbore production tubing uphole of the location. When installed within a wellbore production tubing, the BPV has an uphole end 106 and a downhole end 108.

A threaded connection 110 is attached to the downhole end 108 of the BPV 102. The threaded connection 110 can be a tubular cylindrical member that includes threads (e.g., metal threads) formed on an outer surface or an inner surface or both of the threaded connection 110 to be coupled to the BPV 102 and to the pressure gauge 104, as described later. To couple to the downhole end 108 of the BPV 102, a universal thread profile can be formed on the downhole end 108 of the BPV 102. Metal-to-metal thread connection can be formed between an uphole end 112 the thread profile formed on the downhole end 108 of the BPV 102 and the thread profile formed on the threaded connection 110. The thread profile can extend along an entire length of the threaded connection 110 to connect a downhole end 114 of the threaded connection 110 to other wellbore tools as described below. In some implementations, the thread profile formed at the uphole end 112 can be different from that formed at the downhole end 114 of the threaded connection 110. The threaded connection 110 can be made of a material that can withstand downhole conditions including high temperatures and pressure, and that can maintain a seal formed by the BPV 102 with the wellbore production tubing to fluidically isolate the portion of the wellbore production tubing downhole of the sub-assembly 100 from the portion of the wellbore production tubing uphole of the sub-assembly 100. The threaded connection 110 can help easily and practically connect the BPV 102 and the pressure gauge 104. The threaded connection 110 can be rated to support the weight of the pressure gauge 104. The pressure gauge 104, which includes memory for storing the data, can weight between 500 g and 1000 g. The threaded connection 110 can also reduce vibration during production or installation.

The pressure gauge 104 is fluidically coupled to the BPV 102 through the threaded connection 110. To do so, a thread profile can be formed on or attached to an uphole end of the pressure gauge 104. The thread profile on the pressure gauge 104 can be configured to be received by and mate with the thread profile of the threaded connection 110. In some implementations, the thread profile on the pressure gauge 104 can be formed on an outer surface, and the thread profile of the threaded connection 110 can be formed on an inner surface. In some implementations, the thread profile on the pressure gauge 104 can be formed on an inner surface, and the thread profile of the threaded connection 110 can be formed on an outer surface. The thread profiles can be constructed such that, when engaged, the interface between the threaded connection 110 and the pressure gauge 104 maintains a fluidic isolation of the portion of the wellbore tubing string downhole of the sub-assembly 100. For example, the thread profiles can be metal-to-metal threads.

The pressure gauge 104 is configured to measure a pressure in the portion of the wellbore downhole of the location at which the sub-assembly 100 is installed in the wellbore production string. In some implementations, the pressure gauge 104 can be replaced with a temperature or a combined pressure/temperature gauge or another gauge or sensor that can measure other wellbore properties. The pressure gauge 104 can be an electronic pressure gauge with an onboard memory 116 that is configured to store the pressure sensed by the pressure gauge 104. The pressure values stored on the onboard memory 116 can be transferred to a computer system when the sub-assembly 100 is retrieved after use.

The sub-assembly 100 permits fluid flow in one direction (specifically, the uphole direction) and prevents fluid flow in the opposite direction (specifically, the downhole direction). The downhole end 118 of the pressure gauge 104 is open to fluid flow through the sub-assembly 100 in the uphole direction. However, because the BPV 102 prevents fluid flow in the uphole direction, fluid downhole of the location at which the sub-assembly 100 is installed cannot flow to the surface of the wellbore. In contrast, fluid can be flowed from a surface of the wellbore in the downhole direction through the BPV 102 and the pressure gauge 104.

Figure 2:
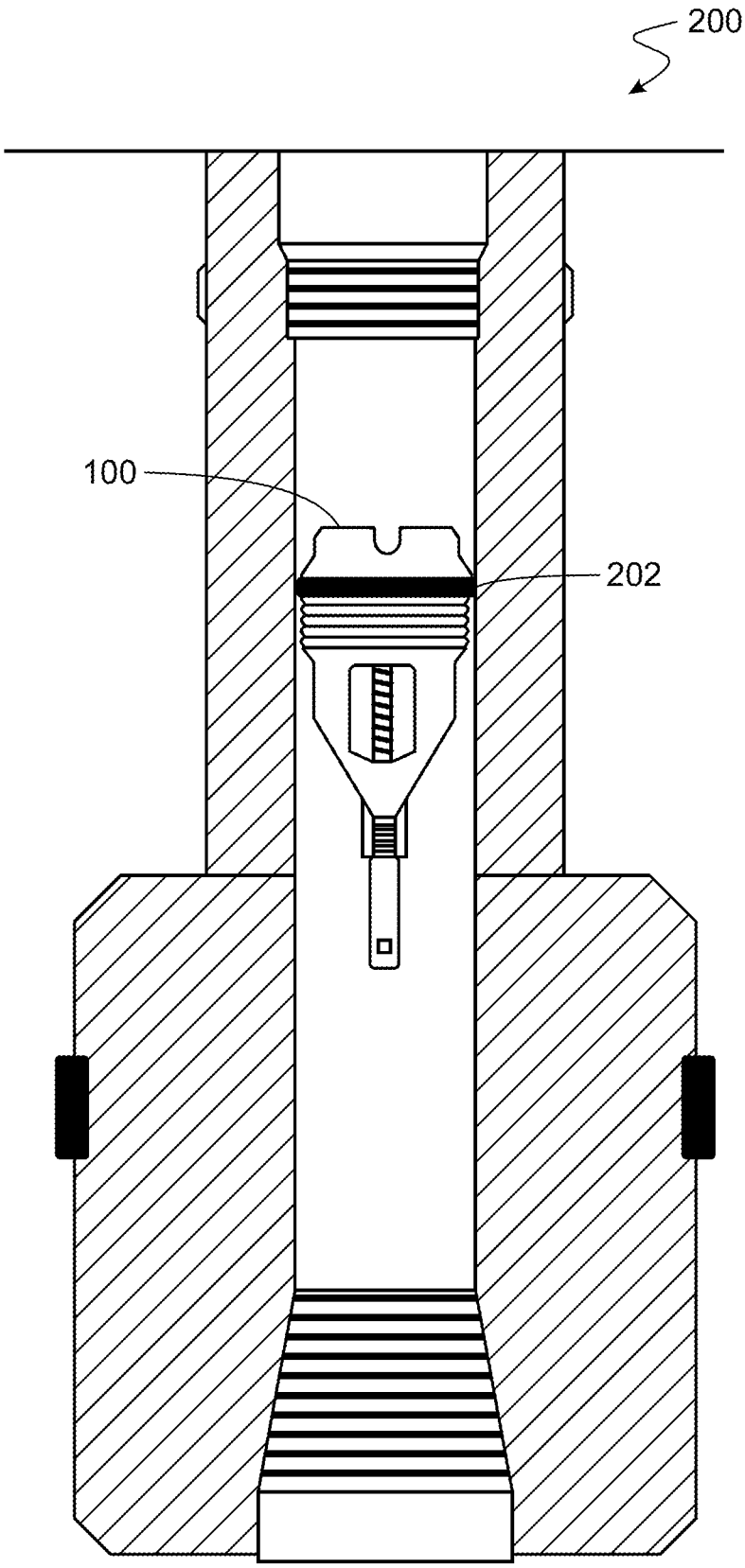
FIG. 2 is a schematic diagram of a tubing hanger landing joint in which the sub-assembly of FIG. 1 is installed.

FIG. 2 is a schematic diagram of a tubing hanger landing joint 200 in which the sub-assembly 100 is installed. The joint 200 is a device in the wellbore to support the wellbore production string (described later). The joint 200 can include a hollow portion with thread profiles near an uphole end of the joint 200 and near a downhole end of the joint 200, each to receive corresponding threads. In particular, the threads near the downhole end of the joint 200 can couple to threads formed on the wellbore production string to hang the string from the joint 200. In some implementations, the sub-assembly 100 is installed within the joint 200 at a pre-determined location. The sub-assembly 100 fluidically isolates the portion of the wellbore production string below the pre-determined location. In some implementations, a BPV profile 202 is formed on an inner surface of the joint 200 to receive the BPV 102 (FIG. 1) of the sub-assembly 100. The BPV profile 202 forms the fluidic seal that creates the fluidic isolation described above. The BPV profile 202 includes an elastomeric O-ring. The tubing hanger BPV housing area has tapered shoulders. During installation of the BPV, the elastomeric O-ring sails between tubing hanger and BPV to generate pressure seal which creates the fluidic isolation.

Figure 3:
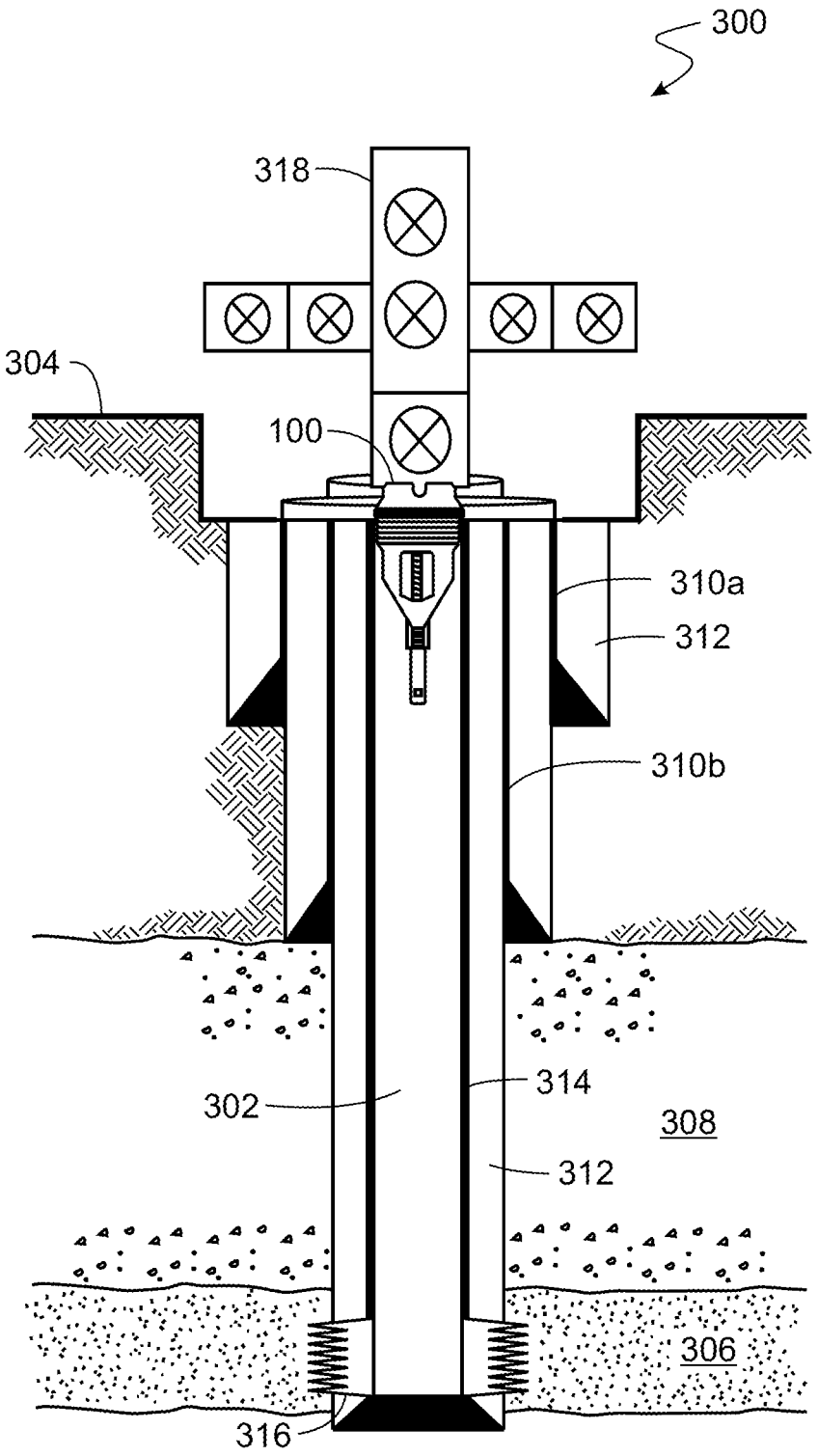
FIG. 3 is a schematic diagram of a well system including the sub-assembly of FIG. 1.

FIG. 3 is a schematic diagram of a well system 300 including the sub-assembly of 100. The well system 100 includes a wellbore 302 formed from a surface 304 of the Earth to a subsurface reservoir 306 through a subterranean zone 308 (e.g., a formation, a portion of a formation, multiple formations) to raise (i.e., produce) hydrocarbons entrapped in the subsurface reservoir 306. After forming the wellbore 302 through the subterranean zone 308 using a wellbore drilling assembly, multiple strings (e.g., casing strings 310*a*, 310*b*) can be lowered into the wellbore 302 and installed in place using cement 312. A wellbore production string 314 can be lowered through the multiple strings to span a length from the wellbore surface 304 to the subsurface reservoir 306. Perforations 316 formed at a downhole end of the wellbore production string 314 can allow the hydrocarbons to enter into the wellbore production string 314 from the subsurface reservoir 306.

Different wellbore completions can be installed in the wellbore production string 314 to produce the hydrocarbons. For ease of illustration, only the sub-assembly 100 and a production tree 318 are schematically shown in FIG. 3. The production tree 318 can include additional components, e.g., valves, etc., using which fluid flow through the wellbore 302 can be operated and controlled. The pre-determined location at which the sub-assembly 100 is installed can be at or as close to the wellbore surface 304 as possible while still being within the wellbore 302. Such a pre-determined location allows easy installation and retrieval of the sub-assembly 100 without the need to perform complex retrieval operations. By installing the sub-assembly 100 at the pre-determined location, fluidic isolation of the portion of the wellbore production string 314 downhole of the pre-determined location can be implemented and simultaneously, pressure in the isolated portion of the wellbore production string 314 can be continuously measured.

Figure 4:
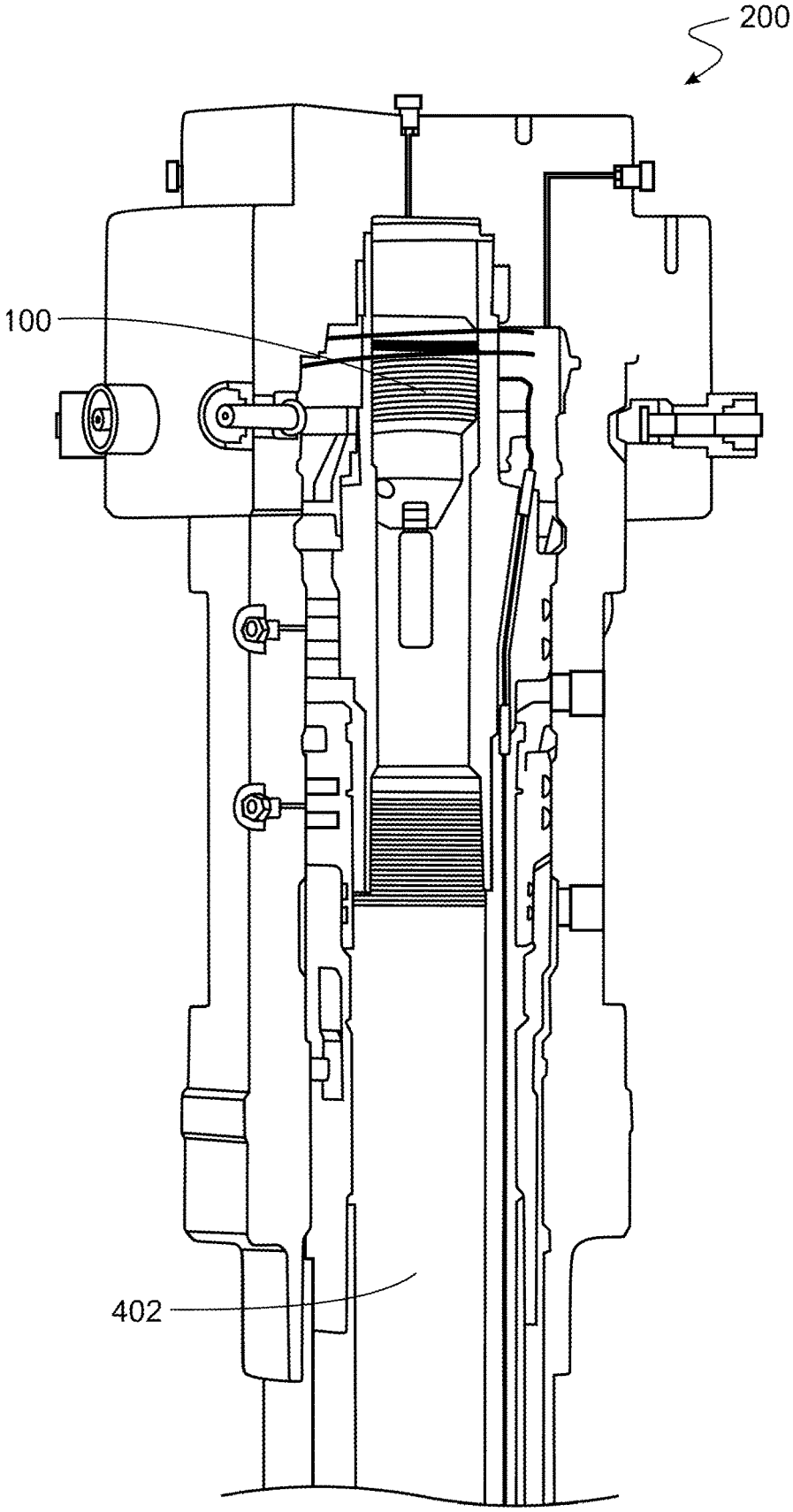
FIG. 4 is a schematic diagram of the tubing hanger landing joint in which the sub-assembly of FIG. 1 is installed.

FIG. 4 is a schematic diagram of the tubing hanger landing joint 200 in which the sub-assembly 100 is installed. A wellbore production string 402 is installed downhole of the sub-assembly 100. For example, a downhole end of the joint 200 can include a threaded profile on an inner surface that can complement a threaded profile on an outer surface of an uphole end of the wellbore production string 402. When the uphole end of the wellbore production string 202 is coupled to the downhole end of the joint 200, a metal-to-metal seal is formed between the threads causing the outer surface of the wellbore production tubing 402 to be fluidically sealed to the inner surface of the joint 200. Uphole of the wellbore production tubing 402, the BPV profile 202 (FIG. 2) formed on an inner surface of the joint 200 forms a similar metal-to-metal seal with the sub-assembly 100. In this manner, the joint 200 enables the sub-assembly 100 to fluidically isolate the wellbore production string 402 downhole of the sub-assembly 100.

Figure 5:
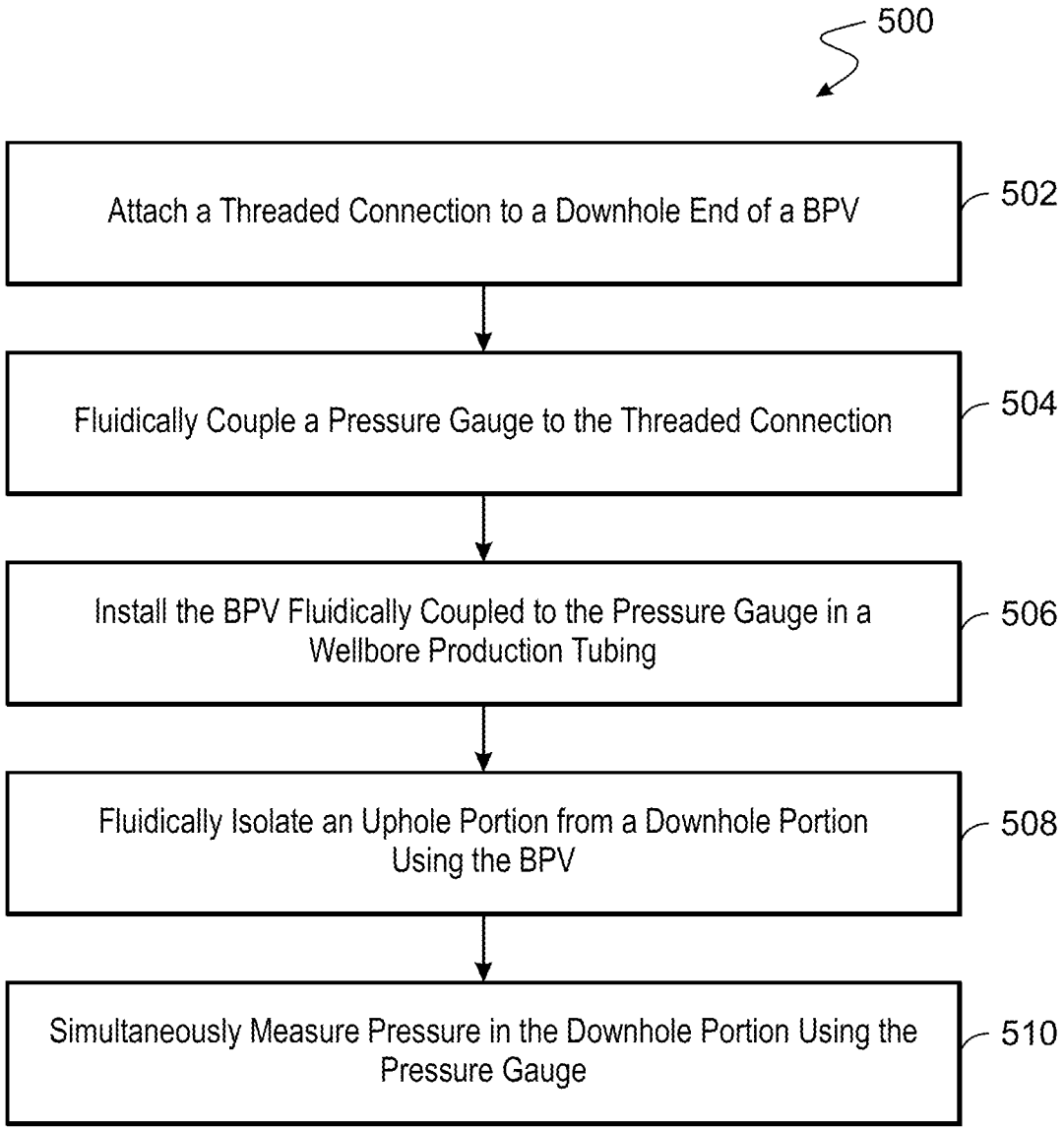
FIG. 5 is a flowchart of an example of a method of forming and using the sub-assembly of FIG. 1.

FIG. 5 is a flowchart of an example of a method 500 of forming and using the sub-assembly 100 (FIG. 1). Some of the method steps can be performed by a human operator. Some of the method steps can be performed by the sub-assembly 100 (FIG. 1). At 502, a threaded connection is attached to a downhole end of a BPV. At 504, a pressure gauge is fluidically coupled to the threaded connection. For example, the method steps 502 and 504 can be performed at a surface of a wellbore. At 506, the BPV, fluidically coupled to the pressure gauge, is installed in a wellbore production tubing. At 508, an uphole portion of the wellbore production string is fluidically isolated from a downhole portion using the BPV. Simultaneously and continuously, at 510, the pressure in the downhole portion is measured using the pressure gauge.

Implementations of the sub-assembly 100 can be implemented using standard Cameron type H BPV outer thread to install the sub-assembly 100 in the tubing hanger joint 200. The sub-assembly 100 described here can record well properties including temperature, pressure, combinations of them, or other well properties using appropriate gauges/sensors while the wellbore production tubing is fluidically isolated with the BPV. The sub-assembly 100 can work when all wellhead valves including those in the production tree are in closed positions. The sub-assembly 100 can allow grease and integrity test for wellhead gate valves during fluidic isolation and pressure monitoring. Implementing the sub-assembly 100 does not require any changes to the tubing hanger. The tubing hanger can be installed with the same BPV profile. Deploying the sub-assembly 100 does not require any kind of slickline or wireline operation for installation or removal from the wellbore. The sub-assembly 100 can be installed with any industry standard BPV lubricator, and can be installed or removed under pressure using the BPV lubricator.

Thus, particular implementations of the subject matter have been described. Other implementations are within the scope of the following claims.

The invention claimed is:

1. A wellbore tool assembly comprising:

a back pressure valve (BPV) configured to be installed at a location in a wellbore production tubing configured to be installed in a wellbore, the BPV configured to fluidically isolate a portion of the wellbore production tubing downhole of the location from a portion of the wellbore production tubing uphole of the location;

a threaded connection attached to a downhole end of the BPV, the threaded connection comprising a first plurality of threads, the threaded connection configured to be installed in the wellbore production tubing; and a pressure gauge fluidically coupled to the BPV through the threaded connection, the pressure gauge configured to be installed in the wellbore production tubing, wherein the pressure gauge is configured to measure a pressure in the portion of the wellbore downhole of the location.

2. The assembly of claim 1, wherein the pressure gauge comprises a second plurality of threads configured to mate with the first plurality of threads to form a fluidic coupling between the BPV and the pressure gauge.

3. The assembly of claim 2, wherein the first plurality of threads are formed on an inner surface of the threaded connection and the second plurality of threads are formed on an outer surface of the pressure gauge.

4. The assembly of claim 1, wherein the BPV coupled to the pressure gauge is configured to allow fluid flow from the portion of the wellbore production tubing uphole of the location to the portion of the wellbore production tubing downhole of the location, and prevent fluid flow from the portion of the wellbore production tubing downhole of the location to the portion of the wellbore production tubing uphole of the location.

5. The assembly of claim 4, wherein the pressure gauge comprises an end that is coupled to the threaded connection and an opposite end, wherein the opposite end is open to fluid flow.

6. The assembly of claim 1, wherein the pressure gauge comprises a memory configured to store the pressure in the portion of the wellbore downhole of the location that is measured by the pressure gauge.

7. The assembly of claim 1, wherein the threaded connection is attached to the downhole end of the BPV by metal-to-metal threads.

8. The assembly of claim 1, further comprising a tubing hanger landing joint configured to be installed in the wellbore uphole of the wellbore production tubing, the tubing hanger landing joint configured to hang the wellbore production tubing, the tubing hanger landing joint configured to receive the BPV fluidically coupled to the pressure gauge.

9. A method comprising:

attaching a threaded connection to a downhole end of a back pressure valve (BPV);

fluidically coupling a pressure gauge to the threaded connection;

installing the BPV fluidically coupled to the pressure gauge at a location in a wellbore production tubing installed in a wellbore;

fluidically isolating, by the BPV, a portion of the wellbore production tubing downhole of the location from a portion of the wellbore production tubing uphole of the location; and simultaneously with the fluidically isolating, measuring, by the pressure gauge, a pressure in the portion of the wellbore production tubing downhole of the location.

10. The method of claim 9, wherein attaching the threaded connection to the downhole end of the BPV comprises forming a metal-to-metal threaded connection between the downhole end of the BPV and the threaded connection.

11. The method of claim 9, wherein fluidically coupling the pressure gauge to the threaded connection comprises coupling a first plurality of threads formed on an inner surface of the threaded connection to a second plurality of threads formed on an outer surface of the threaded connection.

12. The method of claim 9, wherein fluidically isolating, by the BPV, the portion of the wellbore production tubing downhole of the location from the portion of the wellbore production tubing uphole of the location comprises:

allowing, by the BPV, fluid flow from the portion of the wellbore production tubing uphole of the location to the portion of the wellbore production tubing downhole of the location; and preventing, by the BPV, fluid flow from the portion of the wellbore production tubing downhole of the location to the portion of the wellbore production tubing uphole of the location.

13. The method of claim 12, wherein allowing, by the BPV, the fluid flow from the portion of the wellbore production tubing uphole of the location to the portion of the wellbore production tubing downhole of the location comprises allowing the fluid flow through a downhole end of the pressure gauge into the BPV.

14. The method of claim 9, further comprising:

forming the wellbore;

installing a casing string in the wellbore;

installing a tubing hanger landing joint in the casing string;

hanging the wellbore production tubing from the tubing hanger landing joint; and installing the BPV fluidically coupled to the pressure gauge within the tubing hanger landing joint.

15. A wellbore tool assembly comprising:

a tubing hanger landing joint configured to be installed in a wellbore uphole of a wellbore production tubing, the tubing hanger landing joint configured to hang the wellbore production tubing; and a back pressure valve-pressure gauge sub-assembly configured to be installed in the tubing hanger landing joint, the sub-assembly comprising:

a back pressure valve (BPV) configured to be installed at a location in a wellbore production tubing;

a threaded connection attached to a downhole end of the BPV, the threaded connection comprising a first plurality of threads; and a pressure gauge fluidically coupled to the BPV through the threaded connection, wherein the pressure gauge is configured to measure a pressure in the portion of the wellbore downhole of the location while the BPV is configured to simultaneously fluidically isolate a portion of the wellbore production tubing downhole of the location from a portion of the wellbore production tubing uphole of the location.

16. The assembly of claim 15, wherein the pressure gauge comprises a second plurality of threads configured to mate with the first plurality of threads to form a fluidic coupling between the BPV and the pressure gauge.

17. The assembly of claim 16, wherein the first plurality of threads are formed on an inner surface of the threaded connection and the second plurality of threads are formed on an outer surface of the pressure gauge.

18. The assembly of claim 15, wherein the pressure gauge comprises a memory configured to store the pressure in the portion of the wellbore downhole of the location that is measured by the pressure gauge.

19. The assembly of claim 15, further comprising a production tree configured to be installed uphole of the sub-assembly, the production tree coupled to the BPV and configured to control fluid flow through the sub-assembly.

* * * * *